US008439357B2

(12) United States Patent
Arikawa et al.

(10) Patent No.: US 8,439,357 B2
(45) Date of Patent: May 14, 2013

(54) PAPER TRANSPORT DEVICE AND IMAGE FORMING APPARATUS

(75) Inventors: Kiichirou Arikawa, Kanagawa (JP); Masami Ishida, Kanagawa (JP); Shigeru Watanabe, Kanagawa (JP); Yoshiro Konishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/274,666

(22) Filed: Oct. 17, 2011

(65) Prior Publication Data

US 2012/0248682 A1 Oct. 4, 2012

(30) Foreign Application Priority Data

Mar. 28, 2011 (JP) ..... 2011-069697

(51) Int. Cl.
*B65H 29/00* (2006.01)

(52) U.S. Cl.
USPC ..... 271/184; 271/225; 271/902

(58) Field of Classification Search ..... 271/225, 271/265.01, 184, 158.01, 902
See application file for complete search history.

(56) References Cited

U.S. PATENT DOCUMENTS

| | | | | |
|---|---|---|---|---|
| 4,793,605 | A * | 12/1988 | Tajima | 271/9.01 |
| 5,042,790 | A * | 8/1991 | Miller et al. | 271/110 |
| 5,882,130 | A * | 3/1999 | Kumazaki et al. | 400/642 |
| 6,783,026 | B2 * | 8/2004 | Chambers et al. | 271/265.01 |
| 6,926,272 | B2 * | 8/2005 | Carter et al. | 271/258.01 |
| 7,021,622 | B2 * | 4/2006 | Carter et al. | 271/258.01 |
| 7,762,549 | B2 * | 7/2010 | Hirai | 271/270 |

FOREIGN PATENT DOCUMENTS

| | | |
|---|---|---|
| JP | A-2002-154695 | 5/2002 |
| JP | B2-3429197 | 7/2003 |
| JP | A-2007-297141 | 11/2007 |

* cited by examiner

*Primary Examiner* — Jeremy R Severson
(74) *Attorney, Agent, or Firm* — Oliff & Berridge, PLC

(57) ABSTRACT

A paper transport device includes a transport section that transports paper on a first transport path, and reverses a transport direction to transport the paper onto a second transport path, and a detecting section that detects that the paper has arrived at the reversal position, wherein the detecting section includes a first member that is arranged on the first transport path, and changes posture thereof among a first posture, a second posture, and a third posture, a second member that changes posture thereof between a fourth posture and a fifth posture, a detector that detects whether the second member is in the fourth posture or in the fifth posture, and a joint member that couples the first member and the second member together, allows the second member to be in the fourth posture, rotates the second member to the fifth posture, and keeps the second member in the fourth posture.

14 Claims, 15 Drawing Sheets

PAPER TRANSPORT DEVICE AND IMAGE FORMING APPARATUS

CROSS-REFERENCE TO RELATED APPLICATIONS

This application is based on and claims priority under 35 USC 119 from Japanese Patent Application No. 2011-069697 filed Mar. 28, 2011.

BACKGROUND (i) Technical Field

The present invention relates to a paper transport device and an image forming apparatus.

(ii) Related Art

In a paper transport device that is mounted on an image forming apparatus to transport paper within the image forming apparatus, the following detecting sections are known as a detecting section that detects the passage of paper through a transport path.

SUMMARY

According to an aspect of the invention, there is provided a paper transport device including a transport section that transports paper to a reversal position in a first direction on a first transport path, and reverses a transport direction to a second direction that is a direction opposite to the first direction at the reversal position, to transport the paper onto a second transport path that branches from the first transport path; and a detecting section that detects that the paper is transported in the first direction, and has arrived at the reversal position, wherein the detecting section includes a first member that is arranged closer to the reversal position side than a branch point on the first transport path branched to the second transport path, and changes posture thereof among a first posture free of the contact with paper, a second posture where the first member comes into contact with the paper transported in the first direction and has rotated in the first direction from the first posture, and a third posture where the first member comes into contact with the paper transported in the second direction and has rotated in the second direction from the first posture, after the paper has passed in the first direction; a second member that changes posture thereof between a fourth posture and a fifth posture by rotation; a detector that detects whether the second member is in the fourth posture or in the fifth posture; and a joint member that couples the first member and the second member together, allows the second member to be in the fourth posture when the first member is in the first posture, rotates the second member to the fifth posture when a movement in which the first member rotates toward the second posture from the first posture is transmitted to the second member and the first member has rotated to the second posture, and does not transmit a movement in which the first member rotates toward the third posture from the first posture, to the second member, and keeps the second member in the fourth posture.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below.

Figure 1:
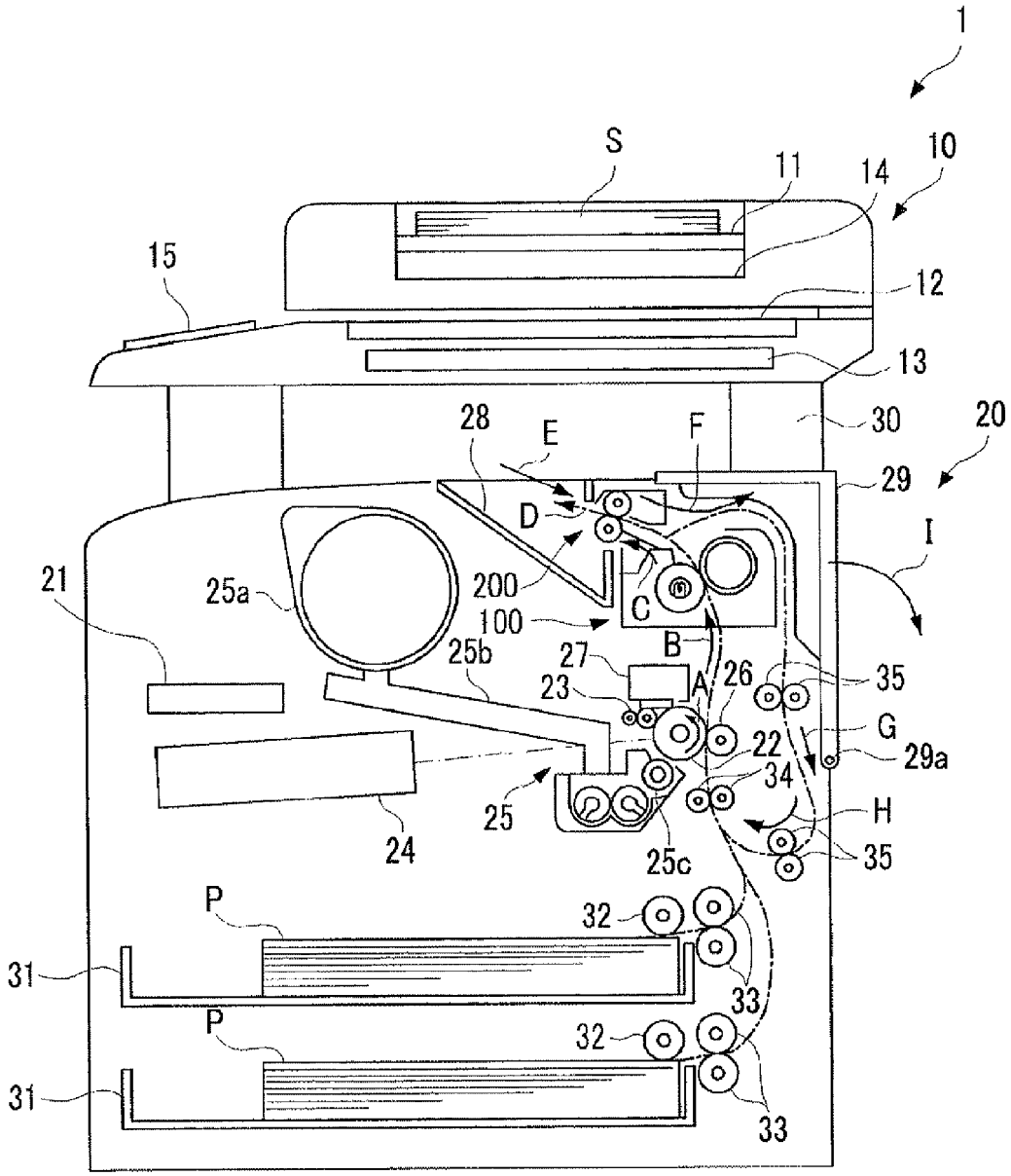
FIG. 1 is a schematic configuration view of a copying machine as one exemplary embodiment of the invention.

FIG. 1 is a schematic configuration view of a copying machine as one exemplary embodiment of the invention.

An image forming apparatus as one exemplary embodiment of the invention and a paper transport device as one exemplary embodiment of the invention are incorporated into the copying machine shown in FIG. 1.

The copying machine 1 has a document reader 10 and an image forming apparatus 20. The document reader 10 is installed at a distance from the image forming apparatus 20 on the image forming apparatus 20 by a frame 30.

The document reader 10 includes a document paper tray 11 on which document sheets S are placed in a superimposed state. The document sheets S placed on the document paper tray 11 are fed out one by one, and are transported on a transport path (not shown) inside the document reader 10. During the transport, characters and images that are recorded on the transported document sheet are read by a document reading optical system 13 placed under a document reading platen 12 made of transparent glass. A document sheet S from which characters and images are read is further transported on the transport path, and is ejected onto a document ejection shelf 14.

Additionally, the document reader 10 has a hinge that extends in the depth direction in the drawing, on the right of the drawing, and the document paper tray 11 and the document ejection shelf 14 are integrally lifted with the hinge as a center of rotation. The document reading platen 12 spreads under the raised document paper tray 11 and document ejection shelf 14.

In the document reader 10, when only one document sheet is placed downward on the document reading platen 12 instead of placing document sheets on the document paper tray 11, the document reading optical system 13 moves from the deep side in the drawing to the near side, and reads characters and images from the document sheet on the document reading platen 12.

Additionally, the document reader 10 is equipped with an operation panel 15 on the left in the drawing. As a user operates the operation panel 15, various setting contents, such as output form of images such as double-sided printing or single-sided printing, or the number of copies, may be input. A setting signal indicating the setting contents input by the operation panel 15 is input to the image forming apparatus 20 from the document reader 10.

Additionally, an image signal acquired as characters and images of a document sheet are read by the document reading optical system 13 is input to the image forming apparatus 20 from the document reader 10.

The image forming apparatus 20 forms an image on the basis of the input image signal as follows.

The image forming apparatus 20 is equipped with a control section 21 that controls the movement of respective constituent elements in the image forming apparatus 20. The setting signal and image signal that are input from the document reader 10 are input to the control section 21 of the image forming apparatus 20. In the image forming apparatus 20, the formation of an image on the basis of the input setting signal and image signal is performed under the control of the control section 21.

Two paper trays 31 are accommodated in a lower part of the image forming apparatus 20. Paper P with different sizes for every paper tray 31 is stored in a stacked state in the paper trays 31. Each paper tray 31 is drawably configured for supply of paper P.

Paper P is fed out by a pickup roller 32 from a paper tray of the two paper trays 31 that stores the paper P of a size matched to the size of a document sheet, or a size set in the setting signal. The fed-out paper P is separated one by one by a separation roller 33, one sheet of the separated paper P is transported upward, and the leading edge of the paper P arrives at a standby roller 34. The standby roller 34 serves to adjust the timing of the subsequent transport, and feed out the paper P, and the paper P that has arrived at the standby roller 34 is further transported after the subsequent transport timing is adjusted by the standby roller 34.

In the mage forming apparatus 20, a photoreceptor 22 that rotates in a direction indicated by arrow A is provided above the standby roller 34. A charger 23, an exposure device 24, a developing device 25, a transfer device 26, and a cleaner 27 are arranged around the photoreceptor 22.

The photoreceptor 22 has a cylindrical shape, holds charges by charging, and discharges the charges by exposure, to form an electrostatic latent image on the surface thereof.

The charger 23 charges the surface of the photoreceptor 22 with a certain charging potential.

Additionally, the image signal acquired by the document reader 10 as mentioned above is input to the exposure device 24 from the control section 21. The exposure light modulated according to the image signal is output from the exposure device 24. The photoreceptor 22 receives exposure caused by the exposure light, and an electrostatic latent image is formed on the surface of the photoreceptor 22.

Moreover, the photoreceptor 22 is exposed by the exposure light and has an electrostatic latent image formed on the surface thereof and then developed by the developing device 25. The developing device 25 includes a toner storage part 25*a*, a toner supply passage 25*b*, and a developing roller 25*c*. In the developing device 25, a toner stored in the toner storage part 25*a* is fed to the vicinity of the developing roller 25*c* through the toner supply passage 25*b*. Then, development is performed by the developing roller 25*c* as the toner is supplied to the photoreceptor 22, and a toner image is formed on the surface of the photoreceptor 22.

Here, the standby roller 34 feeds out paper P such that the toner image on the photoreceptor 22 arrives at a position that faces the transfer device 26 at the timing that the toner image arrives at the position. Then, the toner image on the photoreceptor 22 receives an action of the transfer device 26, and is transferred to the fed-out paper P.

The toner that remains on the photoreceptor 22 after the transfer of the toner image is removed from the photoreceptor 22 by the cleaner 27.

The paper P that has received the transfer of the toner image further advances in the direction of arrow B, and an image consisting of a fixed toner image is formed on the paper P under the heating and pressurization of a fixing device 100.

A combination of the photoreceptor 22, the charger 23, the exposure device 24, the developing device 25, the transfer device 26, and the fixing device 100 is equivalent to an example of the image forming section in the exemplary embodiments of the invention.

The paper P that has passed through the fixing device 100 advances in the direction of arrow C toward an ejector 200, is further fed in the direction of arrow D and ejected onto a paper ejection shelf 28 by the ejector 200.

Here, the image forming apparatus 20 is an apparatus that may form images on both sides of paper P. When images are formed on both sides of paper P, the paper P on which an image is formed only on a first side of the paper P as described above is transported to a reversal position where the trailing edge of the paper has entered the ejector 200 in the direction of arrow C and the direction of arrow D by the ejector 200. Thereafter, the ejector 200 reverses the transport direction of the paper in the direction of arrow E opposite to the direction of arrow D at the reversal position, and the paper P is pulled in the direction of arrow E. The pulled-in paper P advances in the direction of arrow F this time, is further transported in the direction of arrows G and H by a transport roller 35, and arrives at the standby roller 34 again. When the standby roller 34 is returned to, the front and back of the paper P are reversed. Then, the standby roller 34 feeds out the paper P, with a second side opposite to the first side on which an image is already formed directed to the photoreceptor 22 side. Thereafter, an image is formed on the second side similarly to the formation of an image on the first side. The paper P on both sides of which images are formed is now ejected onto the paper ejection shelf 28.

Additionally, in the image forming apparatus 20, a rear panel 29 that covers the fixing device 100 and the ejector 200 is adapted so as to be rotated and opened in the direction of arrow I about a fulcrum 29*a*. In a case where paper P is jammed between the fixing device 100 and the ejector 200, the rear panel 29 is opened by a user. Then, the user inserts his/her hand into an opening, which has appeared by opening the rear panel 29, from the underside of the document reader 10, and removes the jammed paper P.

Figure 2:
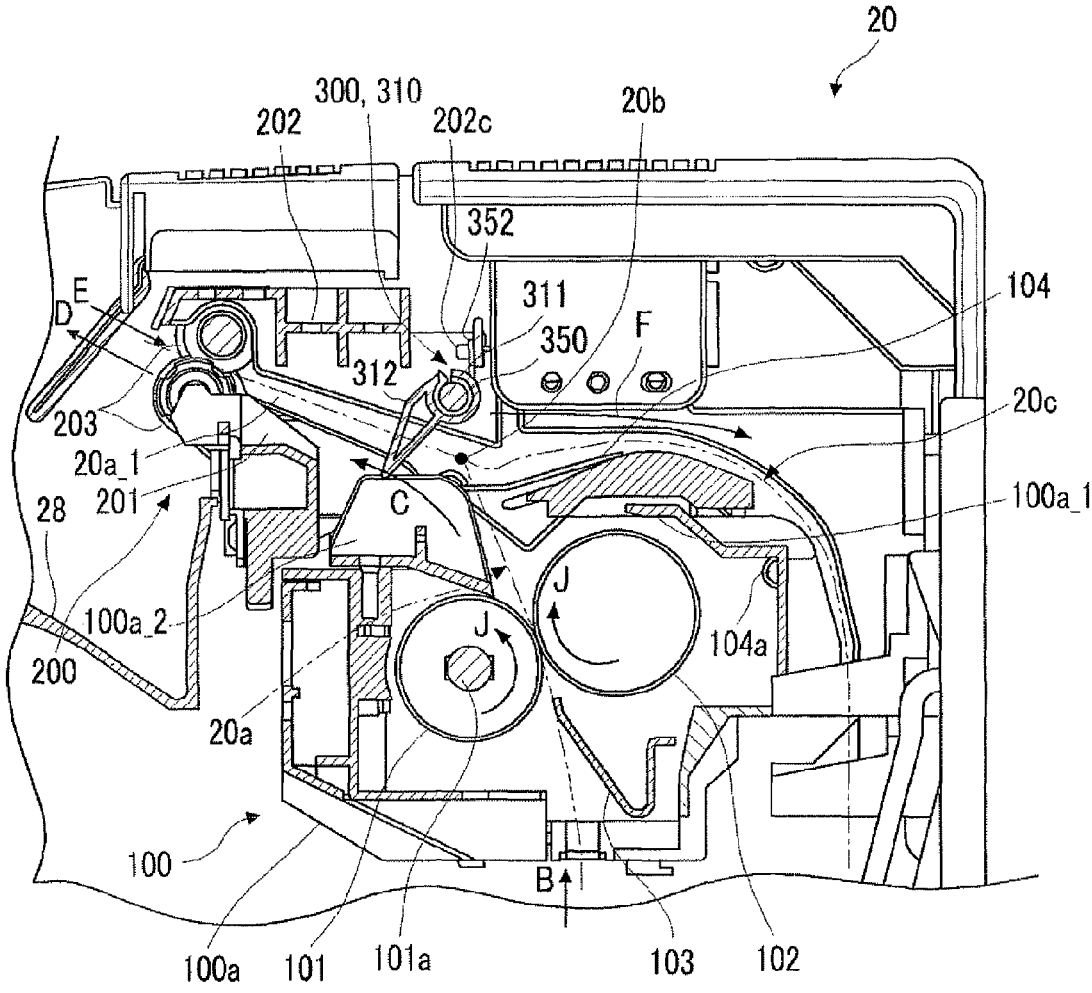
FIG. 2 is a view showing a cross-section of a fixing device and an ejector in the copying machine shown in FIG. 1.

FIG. 2 is a view showing a cross-section of the fixing device and the ejector in the copying machine shown in FIG. 1.

The fixing device 100 has a heating roller 101 and a pressure roller 102. The heating roller 101 is a tubular roller that has a heat source 101*a* therein, and the peripheral surface of the pressure roller 102 that is similarly tubular is pressed against the peripheral surface of the heating roller 101. The paper that has advanced in the direction of arrow B and arrived at the fixing device 100 is guided to a contact portion between the pressure roller 102 and the heating roller 101 by a paper guide 103. The paper is nipped between the heating roller 101 and the pressure roller 102 at the contact portion.

The heating roller 101 and the pressure roller 102 rotate in the direction of arrow J while being brought into contact with each other. For this reason, the paper guided to the contact portion is nipped between the heating roller 101 and the pressure roller 102 at the contact portion, and advances toward the ejector 200. In that case, an image consisting of a fixed toner image is formed on the paper under the heating by the heating roller 101 and the pressurization by the pressure roller 102.

The ejector 200 has a lower frame 201 that plays the role of a lower guide in a first transport path 20*a* that passes through the fixing device 100 and passes through the inside of the ejector 200, and an upper frame 202 that plays the role of an upper guide.

A paper ejection roller 203 that feeds the paper, which has come out of the fixing device 100 in the direction of arrow C, sequentially in the direction of arrow C on the first transport path 20*a*, and further feeds the paper in the direction of arrow D, is supported by the lower frame 201.

When the output form set in the setting signal input to the control section 21 from the document reader 10 is single-sided printing, paper is transported in the direction of arrow D on the first transport path 20*a* and ejected onto the paper ejection shelf 28 as it is by the paper ejection roller 203.

On the other hand, when the output form set in the setting signal is double-sided printing, paper on which an image is formed only on the first side is transported as follows by the paper ejection roller 203. In this case, the paper is first transported in the direction of arrows C and D on the first transport path 20*a* until the trailing edge of the paper arrives at the reversal position where the paper has entered the ejector 200. The ejector 200 has a detecting section 300 for detecting that paper has arrived at the reversal position. The detecting section 300 will be described below in detail.

When the detecting section 300 detects that paper has arrived at the reversal position, the rotation of the paper ejection roller 203 is reversed according to an instruction of the control section 21, whereby the transport direction of the paper is reversed in the direction of arrow E opposite to the direction of arrow D. Then, the paper is transported by the paper ejection roller 203 onto a second transport path 20*c* that branches from the first transport path 20*a* at a branch point 20*b* between the fixing device 100 and the ejector 200.

Figure 3:
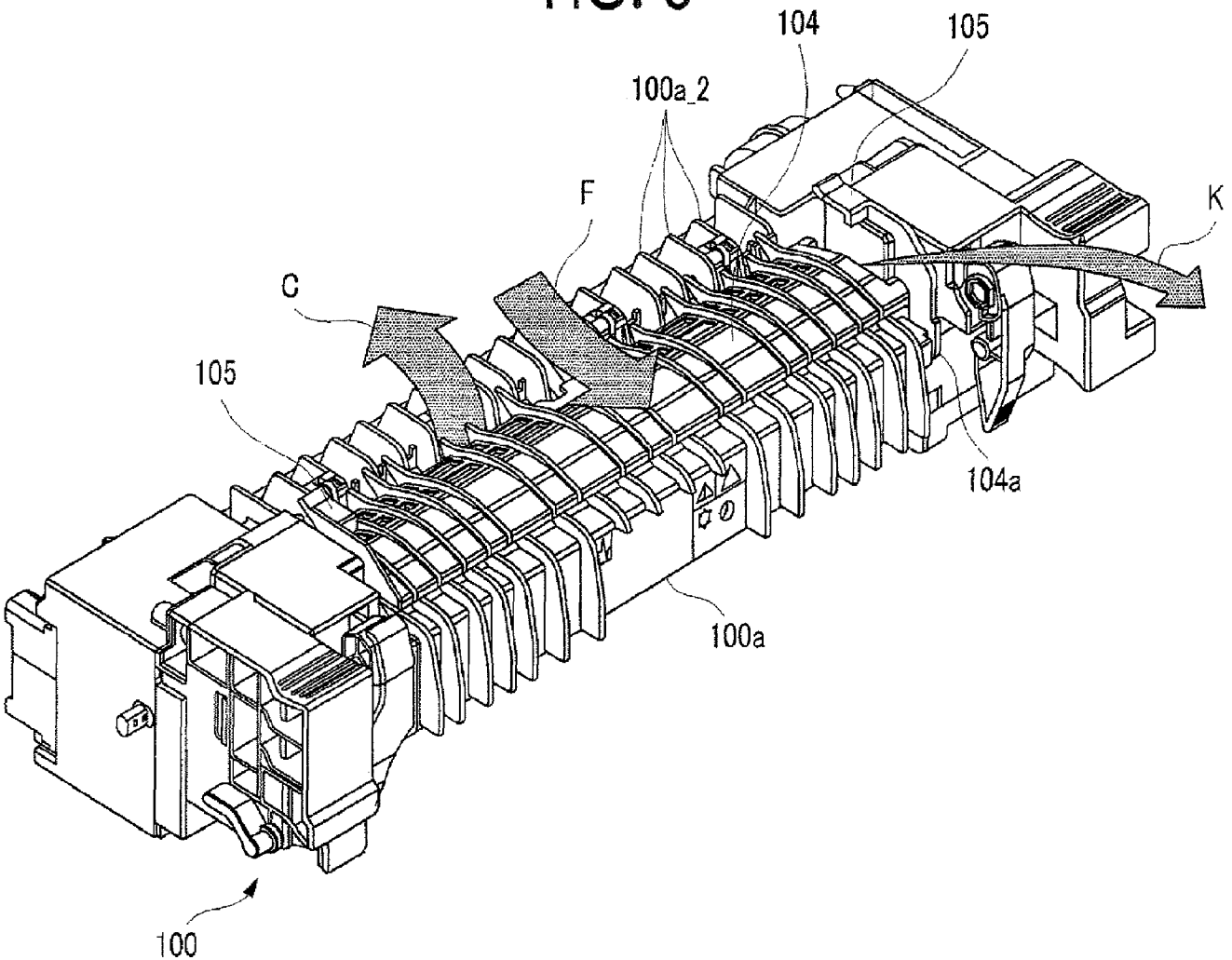
FIG. 3 is an external perspective view showing the fixing device whose cross-section is shown in FIG. 2.

FIG. 3 is an external perspective view showing the fixing device whose cross-section is shown in FIG. 2.

The transport of paper onto the second transport path 20*c* will be described below with reference to both FIGS. 2 and 3.

The fixing device 100 has a frame 100*a* that rotatably supports the heating roller 101 and the pressure roller 102. In the fixing device 100, a cover 104 that covers the contact portion between the heating roller 101 and the pressure roller 102 is attached so as to be openable or closable around the fulcrum 104*a* in the frame 100*a*. The cover 104 is closed in a state where the portion of the cover that is directed to the contact portion strikes an overhang portion 100*a*_1 that overhangs the pressure roller 102 in the frame 100*a* of the fixing device 100.

Additionally, the frame 100*a* of the fixing device 100 has a fixing-device-side guide rib 100*a*_2 that guides paper to the ejector 200 on the first transport path 20*a*. As shown in FIG. 3, plural fixing-device-side guide ribs 100*a*_2 are arranged in the paper width direction. In a state where the cover 104 is closed, the tip of the cover opposite to the fulcrum 104*a* side enters between the fixing-device-side guide ribs 100*a*_2.

The paper that has come out of the fixing device 100 pushes up the tip of the cover 104 and advances in the direction of arrow C on the first transport path 20*a*. On the other hand, the advance of the paper, which is transported in the direction of arrow E by the reversal of the paper ejection roller 203, on the first transport path 20*a*, is obstructed by the cover 104 in the place where the paper arrives at the branch point 20*b*. As a result, the paper is transported in the direction of arrow F on the second transport path 20*c* that branches from the first transport path 20*a* at the branch point 20*b*, and passes through the top face side of the cover 104. The second transport path 20*c* is a path that arrives at the standby roller 34 (refer to FIG. 1) and joins the first transport path 20*a*. As described, the front and back of the paper is reversed as the paper is transported on the second transport path 20*c*. Then, the paper is fed out by the standby roller 34 in a state where the second side on which an image is not formed is directed to the photoreceptor 22 side. Thereafter, an image is formed on the second side similarly to the formation of an image on the first side. The paper on both sides of which images are formed is ejected onto the paper ejection shelf 28.

The ejector 200 is equivalent to one exemplary embodiment of the paper transport device in the exemplary embodiments of the invention. The paper ejection roller 203 is equivalent to one exemplary embodiment of the paper transport device in the exemplary embodiments of the invention.

Here, in the image forming apparatus 20, in a case where paper P is jammed between the fixing device 100 and the ejector 200, as described with reference to FIG. 1, the rear panel 29 is opened by the user. Then, the user inserts his/her hand into the image forming apparatus 20, and removes the jammed paper. The cover 104 of the fixing device 100 is made rotatable around the fulcrum 104*a* as described above, and when paper is removed, the cover 104 is moved and opened about the fulcrum 104*a* by the user.

As shown in FIG. 3, operating levers 105 for allowing the user who tries to remove the jammed paper to open the cover 104 in the direction of arrow K are attached to both ends of the cover 104 in the fixing device 100.

Figure 4:
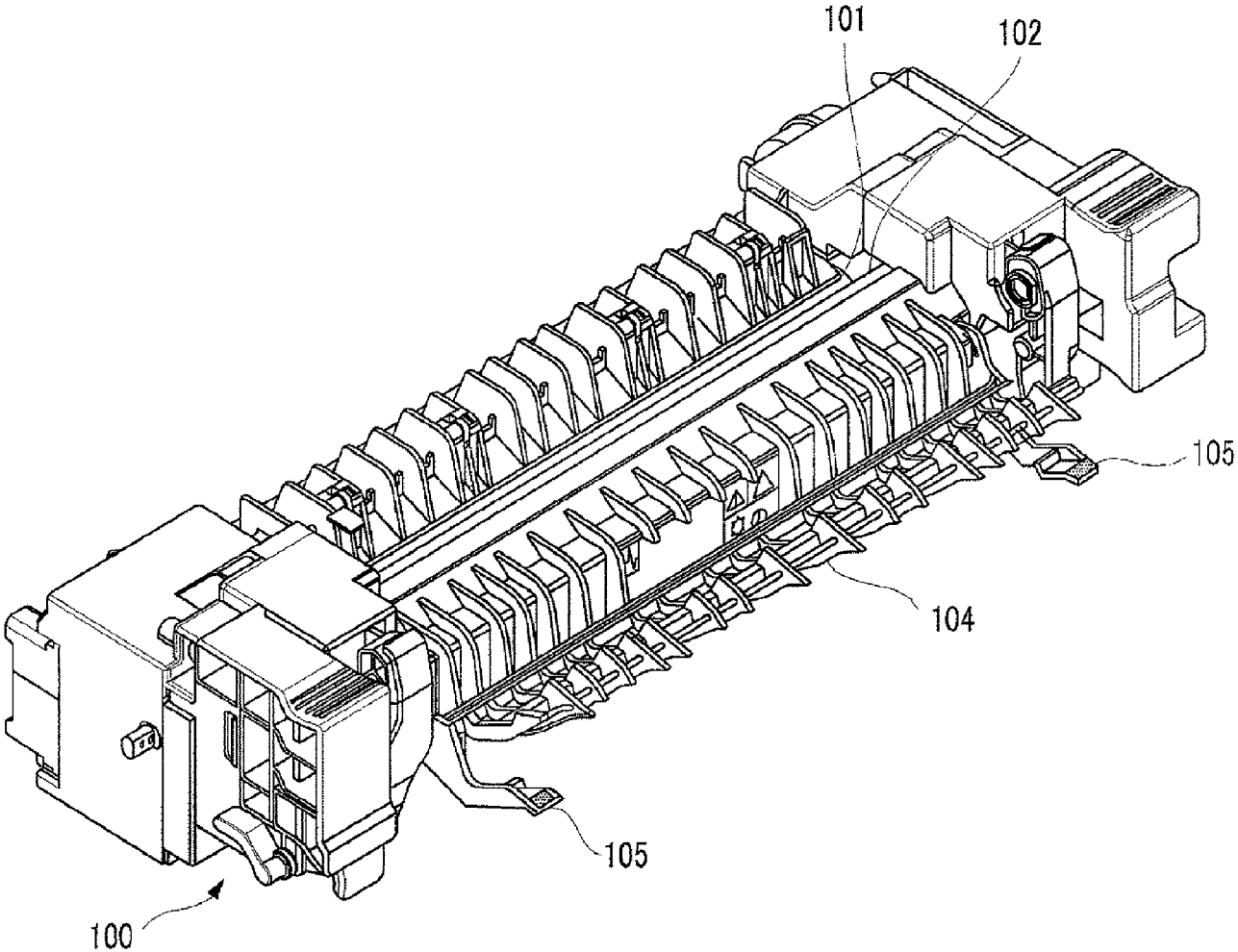
FIG. 4 is an external perspective view when the fixing device whose cover is opened is seen from the same direction as FIG. 3.

FIG. 4 is an external perspective view when the fixing device whose cover is opened is seen from the same direction as FIG. 3.

When a user operates the operating lever 105 to open the cover 104, a transport path from the contact portion between the heating roller 101 and the pressure roller 102 to the ejector 200 in the first transport path 20*a* shown in FIG. 2 is exposed. The user removes jammed paper in a state where the transport path is exposed in this way. The removal of paper will be described once again later.

Figure 5:
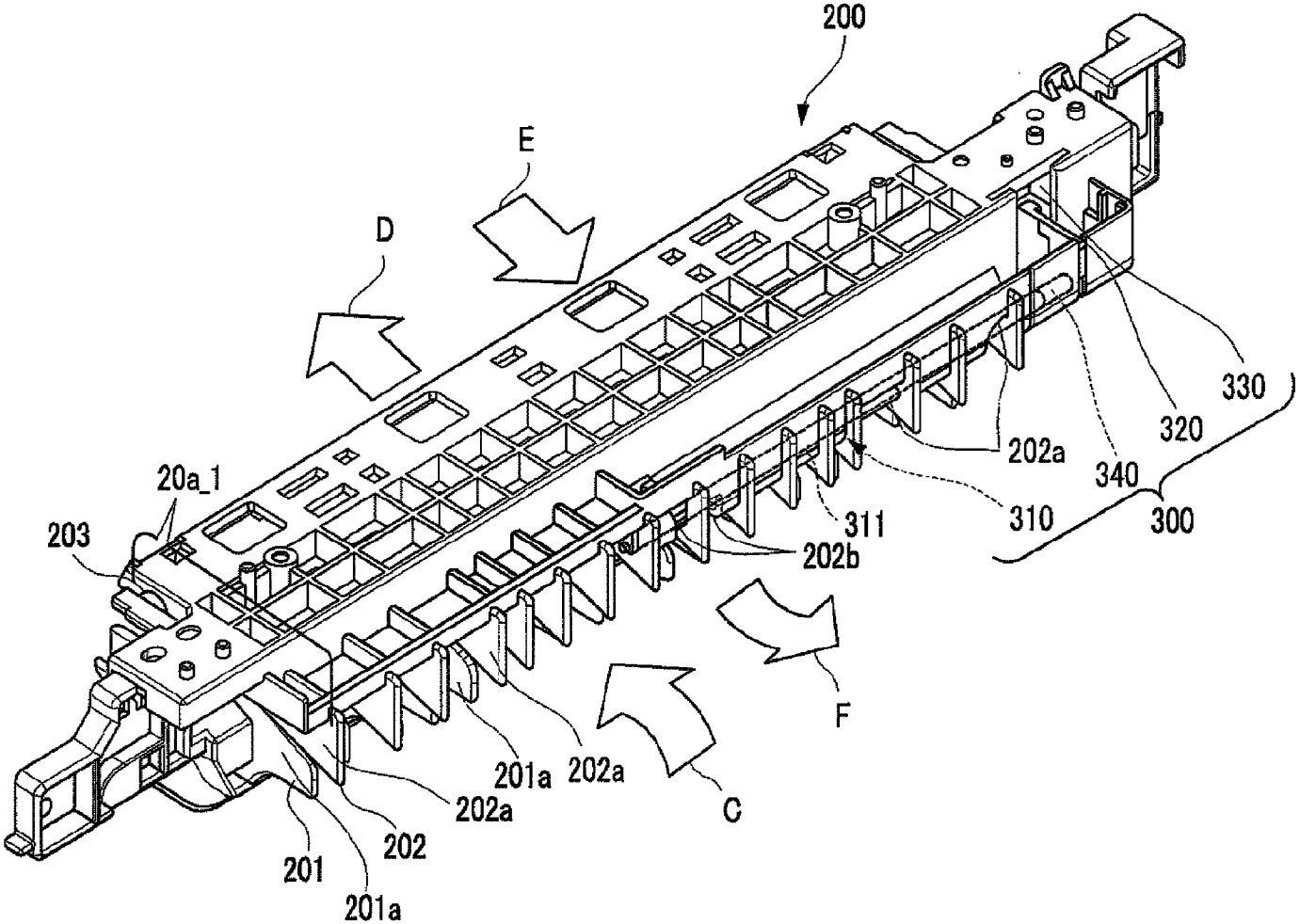
FIG. 5 is an external perspective view when the ejector whose cross-section is shown in FIG. 2 is seen from the oblique upside on the side of the fixing device.

FIG. 5 is an external perspective view when the ejector whose cross-section is shown in FIG. 2 is seen from the oblique upside on the side of the fixing device.

In the ejector 200, the paper that has come out of the fixing device 100 in the direction of arrow C advances into a transport path (a portion of the first transport path 20*a* shown in FIG. 2) formed by the lower frame 201 and the upper frame 202. A transport path from the branch point 20*b* within the ejector 200 shown in FIG. 2 to the paper ejection roller 203 that forms a portion of the first transport path 20*a* is referred to as an internal ejector path 20*a*_1. As shown in FIG. 5, the lower frame 201 has plural lower guide ribs 201*a* that are arranged in the paper width direction. Additionally, the upper frame 202 has plural upper guide ribs 202*a* that are arranged in the paper width direction. Spacing is present between the edge of the lower guide rib 201*a* and the edge of the upper guide rib 202*a*, and this spacing becomes an internal ejector path 20*a*_1. Additionally, the lower guide ribs 201*a* are brought into a state where portions thereof have entered between fixing-device-side guide ribs 100*a*_2 of the frame 100*a* of the fixing device 100 shown in FIGS. 2 and 3, in a state where the ejector 200 is arranged above the fixing device 100.

The paper that has advanced into the internal ejector path 20*a*_1 is transported in the direction of arrow D by the paper ejection roller 203. Additionally, in the case of double-sided printing, the transport direction of paper by the paper ejection roller 203 is reversed in the direction of arrow E after the paper is transported in the direction of arrow D until the trailing edge of the paper enters the internal ejector path 20*a*_1 and arrives at the reversal position. Then, the paper after the reversal is fed out to the second transport path 20*c* in the direction of arrow F from the ejector 200.

The ejector 200 has the detecting section 300 for detecting that paper has arrived at the reversal position. The detecting section 300 is equivalent to an example of the detecting section in the exemplary embodiments of the invention.

The detecting section 300 has a first member 310, a second member 320, a detector 330, and a joint member 340.

The first member 310 is pushed and moved by the paper transported in the direction of arrow D or the direction of arrow E on the internal ejector path 20*a*_1, and changes posture thereof among three postures that will be described below. The first member 310 has a rotating shaft 311 that extends in the paper width direction. The rotating shaft 311 is rotatably inserted into a through hole 202*b* that is provided in the upper frame 202 and extends in the paper width direction from the center of the upper frame 202 to an oblique upper right end in the drawing.

The second member 320 changes posture thereof between two postures that will be described below.

The detector 330 detects whether the second member 320 takes any posture of the two postures. The detector 330 is attached to the lower frame 201.

The joint member 340 couples the first member 310 and the second member 320 together.

Figure 6:
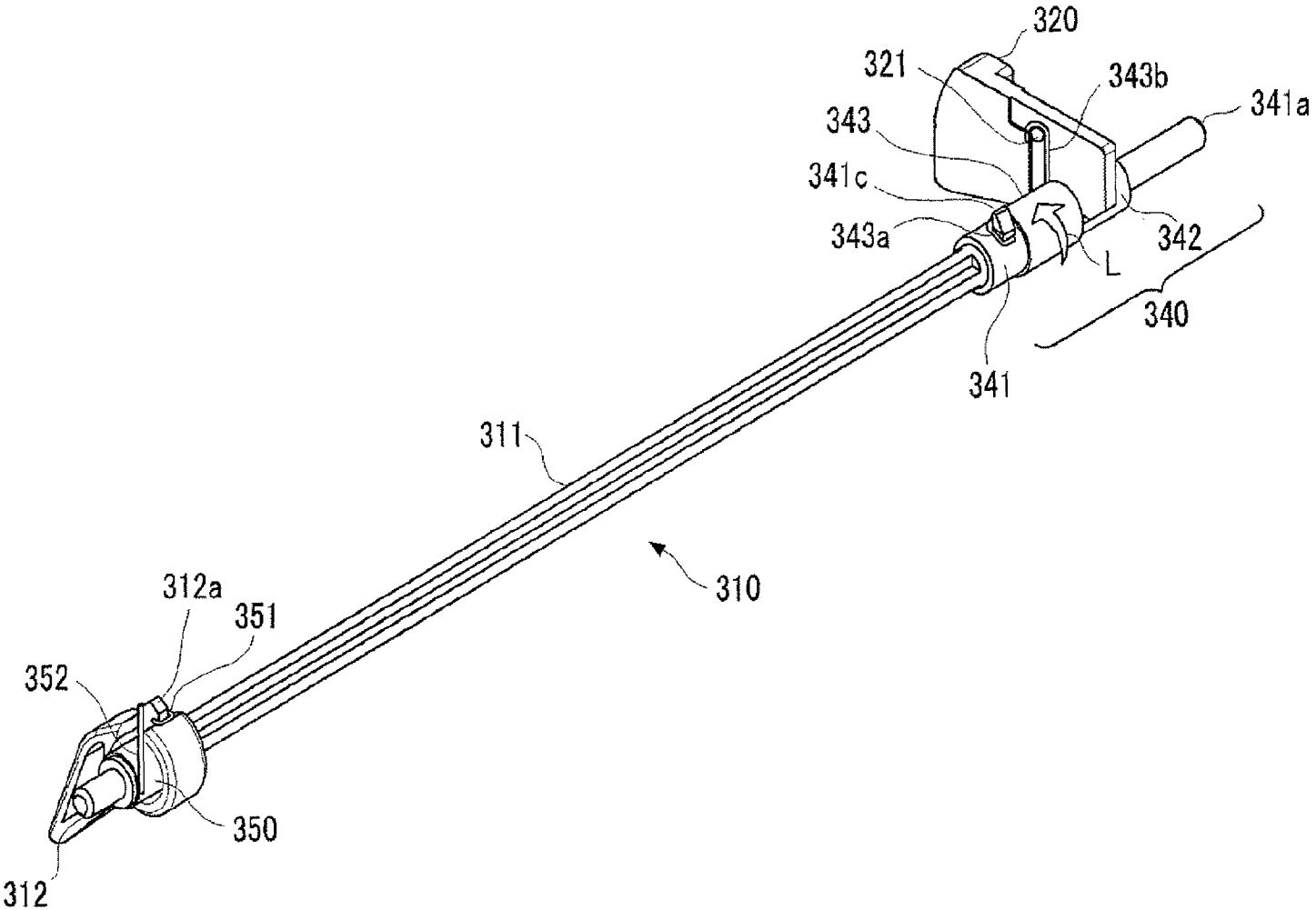
FIG. 6 is a perspective view when a first member and a second member coupled together by a joint member in a detecting section is seen from the same direction as the direction in which the ejector is seen in FIG. 5.

FIG. 6 is a perspective view when the first member and the second member coupled together by the joint member in the detecting section are seen from the same direction as the direction in which the ejector is seen in FIG. 5.

The first member 310 has the rotating shaft 311 and the detecting claw 312.

The detecting claw 312 is a member that is formed integrally with the rotating shaft 311 at one end of the rotating shaft 311 that extends in the paper width direction and whose tip is extended from the rotating shaft 311. As described above, the rotating shaft 311 is rotatably inserted into the through hole 202*b* provided in the upper frame 202 of the ejector 200. The detecting claw 312 that is extended from the rotating shaft 311 is arranged closer to the reversal position than the branch point 20*b* on the internal ejector path 20*a*_1.

Here, in the present exemplary embodiment, paper P with mutually different sizes from the two paper trays 31 shown in FIG. 1 is transported on the first and second transport paths 20*a* and 20*b* such that the center of the paper P in the paper width direction and the center of each transport path in the paper width direction coincide with each other. That is even on the internal ejector path 20*a*_1, paper P is transported such that the center of the paper P in the paper width direction and the center of the internal ejector path 20*a*_1 in the paper width direction coincide with each other.

Then, the detecting claw 312 is arranged at the longitudinal center of the ejector 200 shown in FIG. 5 such that the movement on the internal ejector path 20*a*_1 is reliably detected in both of the two kinds of paper P with mutually different sizes.

Across-section, which passes through the detecting claw 312 so as to cross the rotating shaft 311, in the first member 310 of the detecting section 300 is shown in FIG. 2. In FIG. 2, the second member 320, detector 330, and joint member 340 of the detecting section 300 are hidden by the lower frame 201 and the upper frame 202.

Here, a torsion spring 350 for a detecting claw that will be described below is attached to the first member 310.

The torsion spring 350 for a detecting claw is a spring that generates an urging force between the detecting claw 312 and the upper frame 202, and is attached to the rotating shaft 311 so as to be wound around the portion of the rotating shaft 311 in the vicinity of the detecting claw 312. One end 351 of the torsion spring 350 for a detecting claw is fixed to a projection 312*a* provided at the detecting claw 312. Additionally, the other end 352 of the torsion spring 350 for a detecting claw is fixed to a projection 202*c* shown in FIG. 2, which is provided in the upper frame 202.

The first member 310 takes a first posture where the tip of the first member is extended to the internal ejector path 20*a*_1, when paper has not passed through the internal ejector path 20*a*_1 shown in FIG. 2. In this first posture, the tip of the detecting claw 312 is extended to the space between the fixing-device-side guide ribs 100*a*_2 shown in FIG. 2 and between the lower guide ribs 201*a* shown in FIG. 5. The detecting claw 312 is brought into a state where the detecting claw is rotatable in any direction of the paper ejection roller 203 side and the fixing device 100 side from the first posture. Then, when the detecting claw 312 is pushed on the paper that passes through the internal ejector path 20*a*_1 in the directions of arrows C and D or in the direction of arrow E, and the first member 310 rotates in either of the above directions, the torsion spring 350 for a detecting claw is twisted. Thereby, when the detecting claw 312 is pushed on paper and rotates, an urging force that returns the first member 310 to its original position is generated in the torsion spring 350 for a detecting claw.

As shown in FIG. 6, the second member 320 is coupled via the joint member 340 to the other end the rotating shaft 311 opposite to one end at which the detecting claw 312 is formed.

The second member 320 is a plate that crosses the rotating shaft 311 and whose tip is extended in the direction of separating from the rotating shaft 311. Additionally, in the present exemplary embodiment, the second member 320 has a larger thickness on the tip side than the thickness of a root portion on the rotating shaft 311 side.

The joint member 340 couples the rotating shaft 311 and the second member 320 together, and has a first joint portion 341, a second joint portion 342, and a torsion spring 343 for a joint.

The first joint portion 341 is formed integrally with the rotating shaft 311 at the other end of the rotating shaft 311. Additionally, the second joint portion 342 is formed integrally with the second member 320.

The torsion spring 343 for a joint is attached to the first joint portion 341 and the second joint portion 342 so as to be wound around the both the first joint portion 341 and the second joint portion 342.

Figure 7:
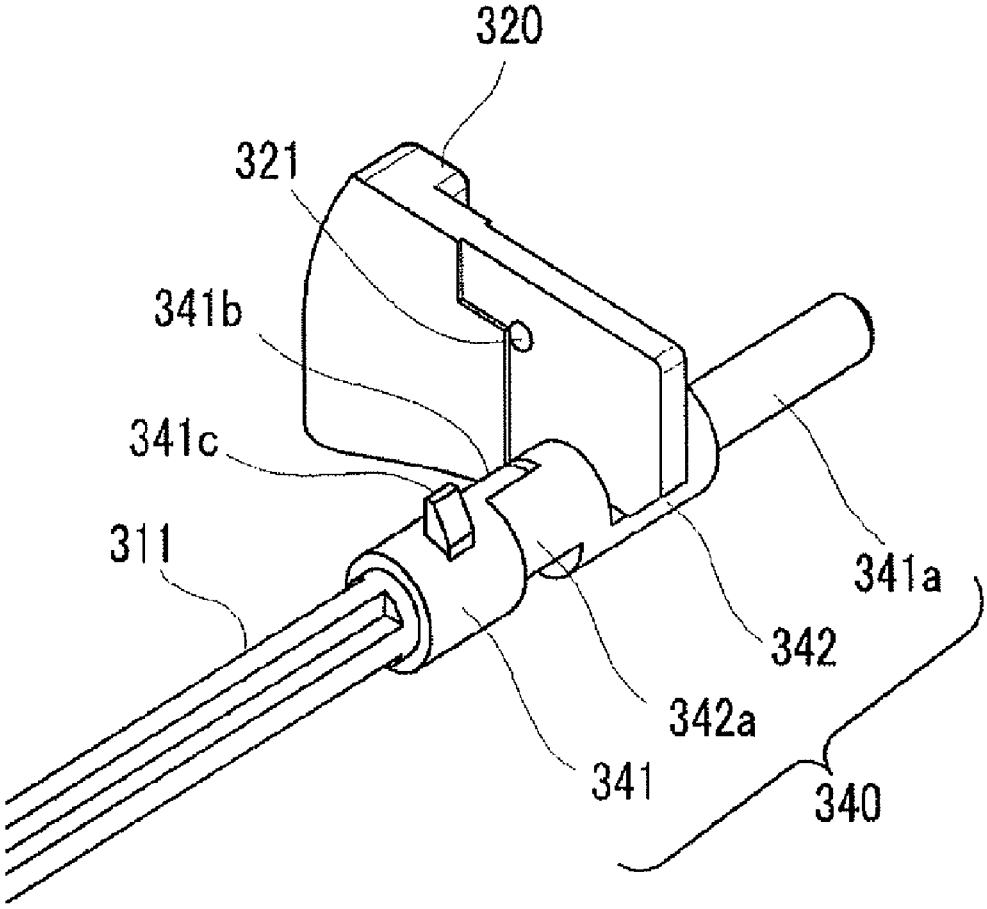
FIG. 7 is a view showing the joint member in a state where a torsion spring for a joint is removed.

FIG. 7 is a view showing the joint member in a state where the torsion spring for a joint is removed.

A shaft portion 341*a* extends in the extension direction of the rotating shaft 311 from the first joint portion 341 in the joint member 340. The shaft portion 341*a* is rotatably inserted into a through hole provided in the second joint portion 342.

Additionally, the first joint portion 341 has a first butting portion 341*b* that extends toward the second joint portion 342. The second joint portion 342 has a second butting portion 342*a* that extends toward the first joint portion 341.

One end 343*a* of the torsion spring 343 for a joint shown in FIG. 6 is fixed to a projection 341*c* provided on the first joint portion 341.

Additionally, the other end 343*b* of the torsion spring 343 for a joint is fixed to a projection 321 provided on the second member 320 that is integrated with the second joint portion 342. At this time, the torsion spring 343 for a joint is twisted such that an urging force in the direction of arrow L in which the second member 320 is brought close to the projection 341*c* of the first joint portion 341 is generated.

As shown in FIG. 7, the first joint portion 341 and the second joint portion 342 are coupled together in a state where the second butting portion 342*a* butts against the first butting portion 341*b* by this urging force. As a result, the first member 310 and second member 320 are coupled together in a state where the second butting portion 342*a* butts against the first butting portion 341*b*.

With that, the description of the first member 310 and second member 320 that are coupled together by the joint member 340 will be ended, and then, the detector 330 in the detecting section 300 will be described.

As described above, the detector 330 is attached to the lower frame 201.

Figure 8:
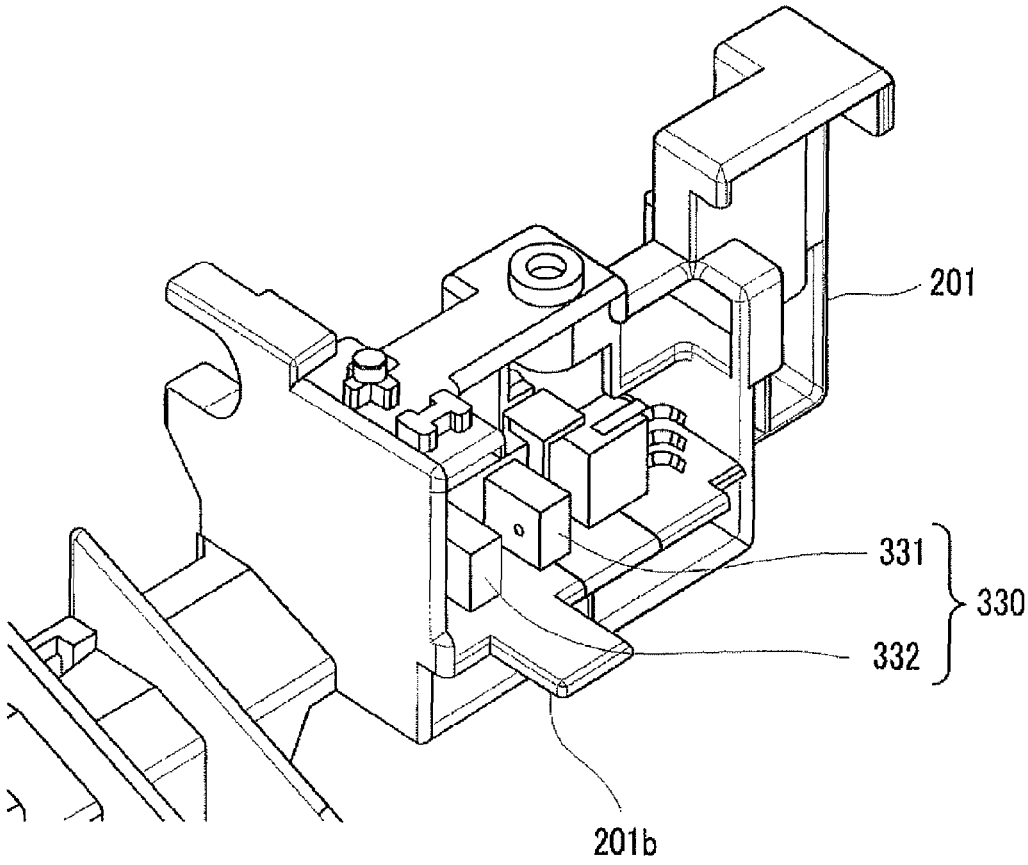
FIG. 8 is a perspective view showing the part of a lower frame to which a detector is attached.

FIG. 8 is a perspective view showing the part of the lower frame to which the detector is attached.

In the detector 330, a light emitting element 331 and a light receiving element 332 are arranged on a plate 201*b* within the lower frame 201 with the spacing therebetween. When the light emitted from the light emitting element 331 is detected by the light receiving element 332, the detector 330 outputs a signal indicating the event. A state where the detector 330 outputs a signal is referred to as an ON state, and a state where the detector does not output a signal is referred to as an OFF state.

In the detecting section 300 shown in FIG. 5, when the first member 310 is in the first posture where the first member does not rotate, the second member 320 is located between the light emitting element 331 and the light receiving element 332.

Figure 9:
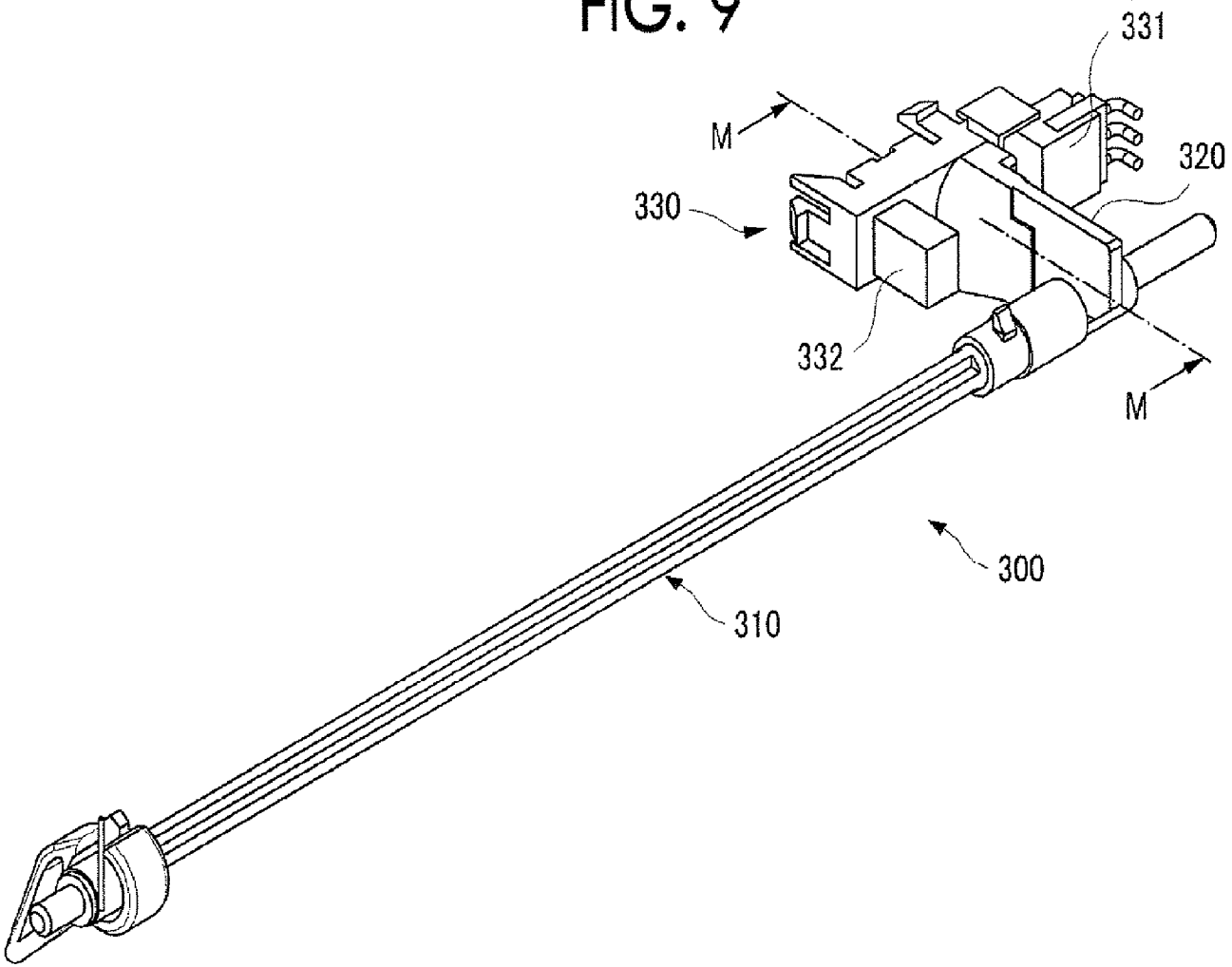
FIG. 9 is a perspective view showing the detecting section when the first member is in a first posture.

FIG. 9 is a perspective view showing the detecting section when the first member is in the first posture.

As shown in FIG. 9, in the detecting section 300, when the first member 310 is in the first posture, the light that is directed to the light receiving element 332 from the light emitting element 331 in the detector 330 is blocked by the second member 320. That is, in the detecting section 300, when the first member 310 is in the first posture, the detector 330 is brought into an OFF state.

Figure 10:
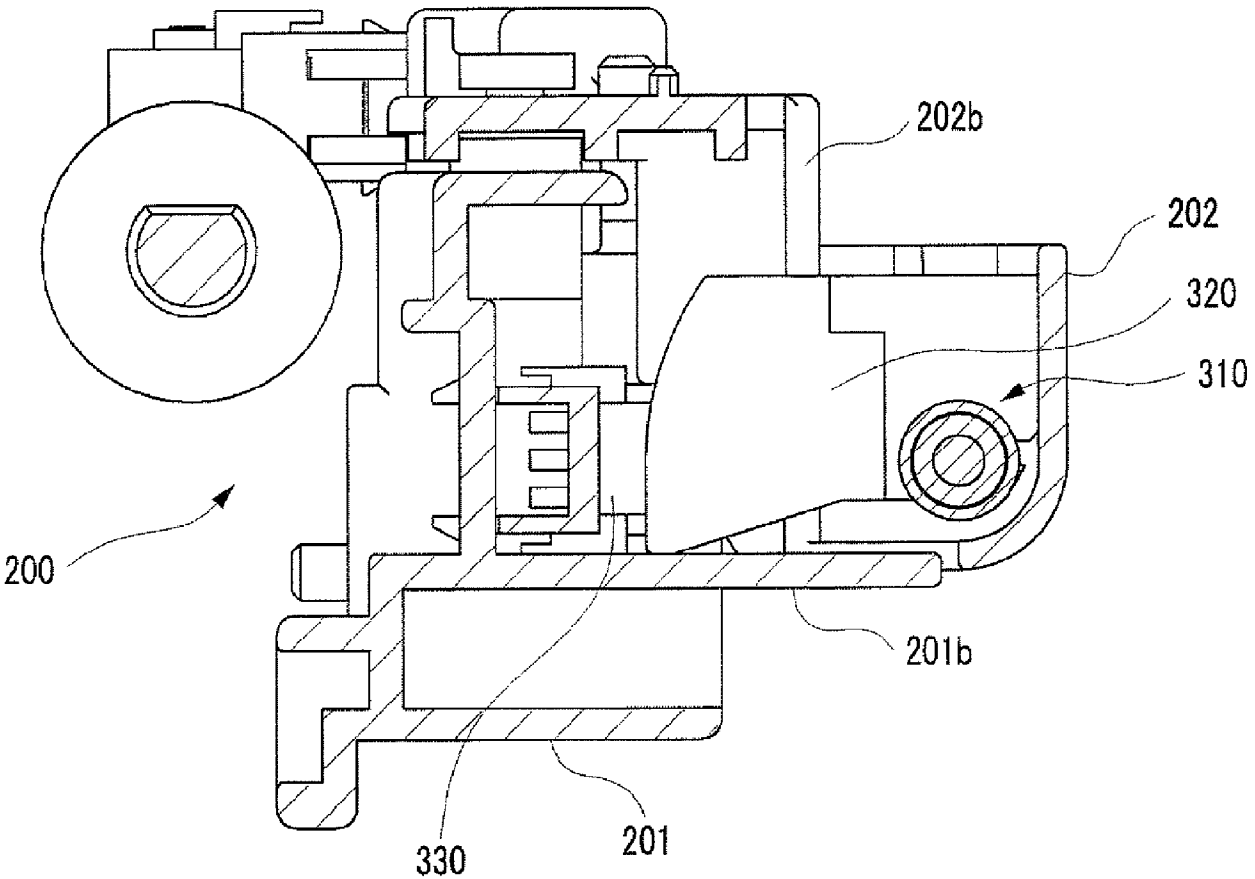
FIG. 10 is a view showing a cross-section passing through a one-dot chain line M-M in FIG. 9 in the detecting section, along with a cross-section of an upper frame or a lower frame of the ejector equipped with the detecting section.

FIG. 10 is a view showing a cross-section passing through a one-dot chain line M-M in FIG. 9 in the detecting section, along with a cross-section of the upper frame or the lower frame of the ejector equipped with the detecting section.

As shown in FIG. 10, in the ejector 200, when the first member 310 of the detecting section 300 is in the first posture, the second member 320 takes the following posture. That is, the second member 320 takes a posture (OFF posture) where the second member 320 advances into the lower frame 201 from the upper frame 202, and brings the detector 330 into an OFF state. In this OFF posture, the tip of the second member 320 comes into contact with the plate 201*b*, which is shown also in FIG. 8, within the lower frame 201. The plate 201*b* is equivalent to an example of a rotation inhibiting portion in the exemplary embodiments of the invention.

Next, in the ejector 200, the movement of the first member 310 and the second member 320 in the detecting section 300 when paper is transported on the internal ejector path 20*a*_1 that becomes a portion of the first transport path 20*a* shown in FIG. 2 will be described.

Before paper is transported, the first member 310 of the detecting section 300 is in the first posture. As shown in FIG. 2, this first posture is brought into a posture where the detecting claw 312 of the first member 310 crosses the internal ejector path 20*a*_1. The second member 320 takes the OFF posture.

When the first member 310 takes the first posture and the second member 320 takes the OFF posture, paper is transported in the direction of arrow C shown in FIGS. 2 and 5 from the fixing device 100 to the internal ejector path 20*a*_1 of the ejector 200.

Figure 11:
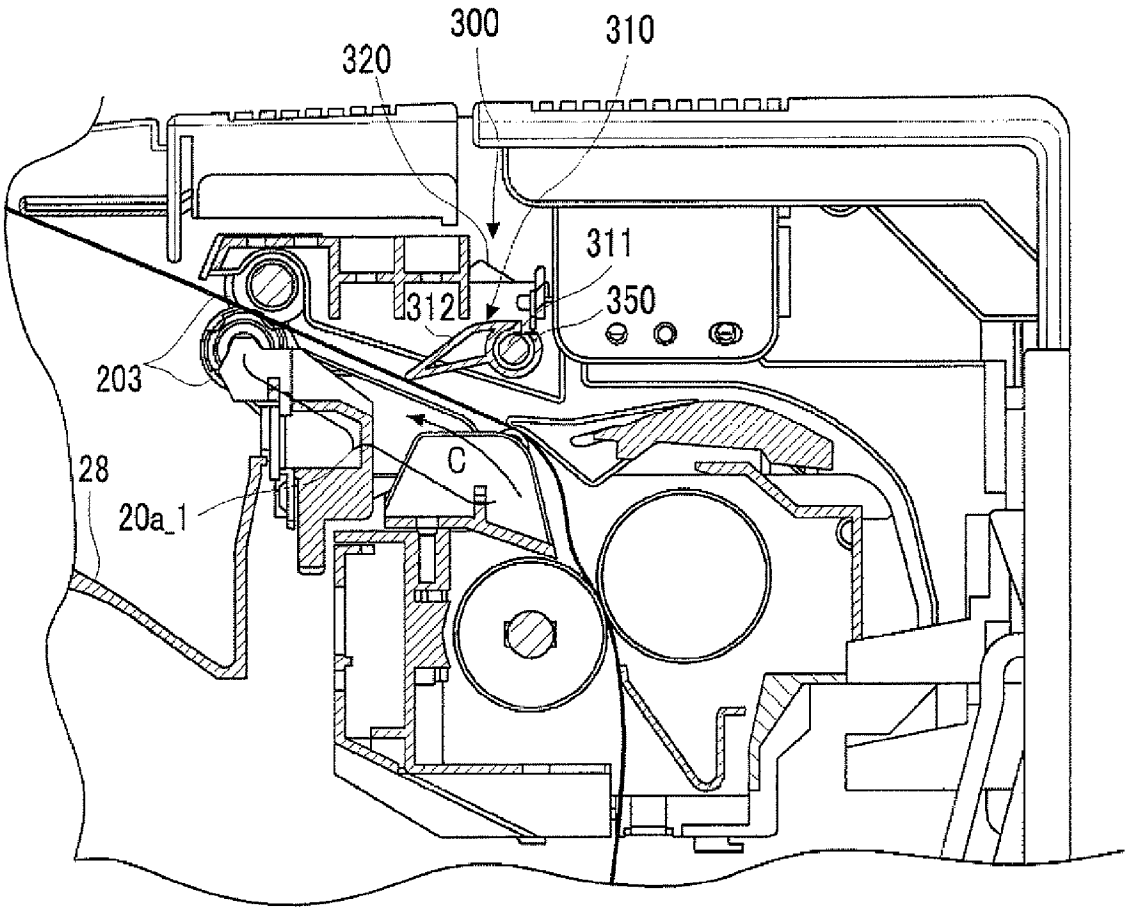
FIG. 11 is a view showing the movement of the first member when paper is transported in a direction of arrow C shown in FIG. 2 to an internal ejector path, in the same cross-section as the cross-section of FIG. 2.

FIG. 11 is a view showing the movement of the first member when paper is transported in the direction of arrow C shown in FIG. 2 to an internal ejector path, in the same cross-section as the cross-section of FIG. 2.

When paper P transported in the direction of arrow C advances into the internal ejector path 20*a*_1, the detecting claw 312 of the first member 310 comes into contact with the paper P. As a result, the first member 310 rotates from the first posture shown FIG. 2 to the second posture rotated in the direction of arrow C. At this time, the second member 320 in the detecting section 300 also rotates as described below, from the OFF posture shown in FIG. 9 or 10.

Figure 12:
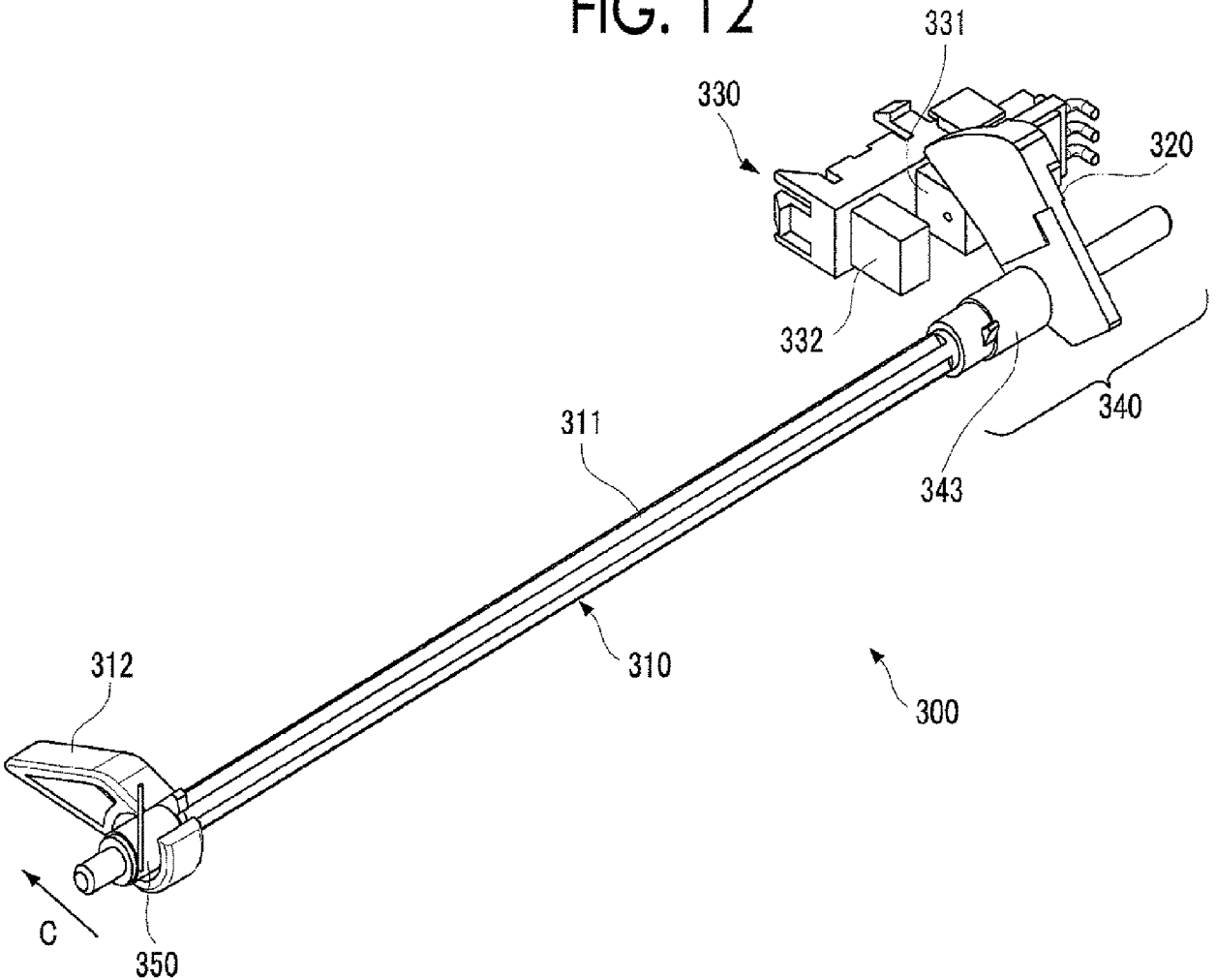
FIG. 12 is a perspective view showing the detecting section in which a detecting claw has rotated to a second posture.

FIG. 12 is a perspective view showing the detecting section in which the detecting claw has rotated to the second posture.

As described with reference to FIGS. 6 and 7, in the detecting section 300, the second member 320 is coupled to the first member 310 in a state where the second butting portion 342*a* butts against the first butting portion 341*b* due to the urging force of the torsion spring 343 for a joint of the joint member 340. For this reason, the movement of the first member 310 to rotate to the second posture is transmitted to the second member 320 via the joint member 340, and the second member 320 rotates together with the first member 310.

When the first member 310 has rotated to the second posture, the second member 320 rotates to a posture (ON posture) where the light emitted from the light emitting element 331 in the detector 330 is passed to the light receiving element 332, bringing the detector 330 into the ON state.

As shown in FIG. 11, while the trailing edge of paper P is out of the internal ejector path 20*a*_1, the posture of the first member 310 is kept in the second posture, and the posture of the second member 320 is also kept in the ON posture. During this time, the detector 330 is kept in the ON state.

When the first member 310 rotates from the first posture shown in FIG. 2 to the second posture shown in FIG. 11, the torsion spring 350 for a detecting claw is twisted, and an urging force that returns the first member 310 to the first posture is generated in the torsion spring 350 for a detecting claw.

Accordingly, the first member 310 returns to the first posture free of the contact with paper P at the timing where the trailing edge of the paper P has entered the internal ejector path 20*a*_1 and has passed the bottom of the detecting claw 312 in the direction of arrow C, i.e., at the timing where the paper P has arrived at the reversal position.

In this way, in the present exemplary embodiment, the returning of the first member 310 is performed reliably and rapidly compared to a case where, for example, the torsion spring 350 for a detecting claw is not present, and the return from the second posture to the first posture is performed, for example, due to the weight of the detecting claw 312.

Here, the torsion spring 350 for a detecting claw is arranged at one end of the rotating shaft 311 on the detecting claw 312 side.

It is supposed that the torsion spring 350 for a detecting claw is arranged at the other end of the rotating shaft 311 opposite to the detecting claw 312 side. In this case, a mechanism for allowing the torsion spring 350 for a detecting claw to urge the first member 310, without interfering with the movement of the joint member 340 shown in FIG. 6 or the like, which is arranged at this other end, is required.

In the present exemplary embodiment, since the torsion spring 350 for a detecting claw is arranged at one end of the rotating shaft 311 on the detecting claw 312 side, the above mechanism is not required, and the structure for return becomes simple compared to the case where the torsion spring 350 for a detecting claw is arranged at the other end.

The movement of return of the first member 310 is also transmitted to the second member 320 via the joint member 340, and the first member 310 returns, and simultaneously the second member 320 also rotates to the OFF posture from the ON posture. The detector 330 is brought into the OFF state at the timing when the second member 320 has rotated to the OFF posture.

In addition, in the present exemplary embodiment, the second member 320 has a larger thickness on the tip side than the thickness of a root portion on the rotating shaft 311 side as described above. For this reason, the second member 320 has a center of gravity at a position farther from the rotating shaft 311 than a middle point of a line segment that connects the rotating shaft 311 and a tip farthest from the rotating shaft 311 in the radial direction. In this way, the center of gravity of the second member 320 is closer to the tip side. The second member 320 that has rotated to the OFF posture hits the plate 201*b* shown in FIG. 10, and is made to rebound slightly by the plate 201*b*. At this time, since the center of gravity of the second member 320 is closer to the tip side, the extent of the rebounding of the second member 320 that has hit the plate 201*b* is suppressed.

When the output form set in the setting signal input to the control section 21 from the document reader 10 shown in FIG. 1 is single-sided printing, the paper P transported on the first transport path 20*a* is ejected onto the paper ejection shelf 28 as it is.

On the other hand, when the output form set in the setting signal is double-sided printing, the paper ejection roller 203 is reversed by the control section 21 at the timing when the detector 330 that has been once brought into the ON state is brought into the OFF state. Then, the paper P is at this point transported in a direction opposite to the direction of arrow C inside the internal ejector path 20*a*_1.

Figure 13:
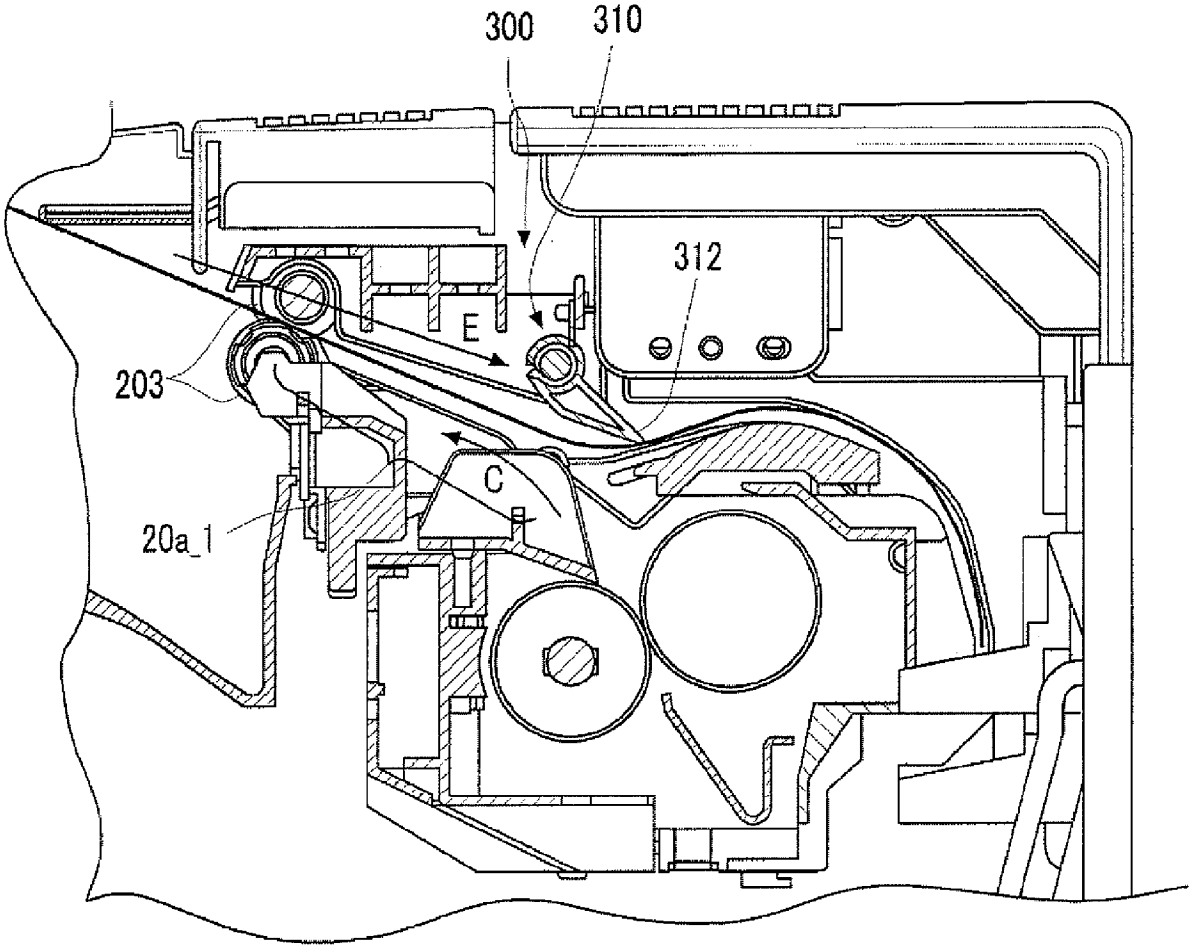
FIG. 13 is a view showing the movement of the first member when paper is transported in a direction opposite to the direction of arrow C shown in FIG. 11 within an internal ejector path, in the same cross-section as the cross-section of FIG. 11.

FIG. 13 is a view showing the movement of the first member when paper is transported in a direction opposite to the direction of arrow C shown in FIG. 11 within an internal ejector path, in the same cross-section as the cross-section of FIG. 11.

Paper P is transported in the direction of arrow E that is a direction opposite to the direction of arrow C shown in FIG. 11, within the internal ejector path 20*a*_1 by the reversal of the paper ejection roller 203. Then, the detecting claw 312 comes into contact with the paper P transported in the direction of arrow E. As a result, the first member 310 now rotates from the first posture shown FIG. 2 to the third posture where the first member has rotated in the direction of arrow E.

Here, as described with reference to FIG. 10, the tip of the second member 320 in the OFF posture comes into contact with the plate 201*b* in the lower frame 201. The movement of the first member 310 that rotates from the first posture to the third posture is a movement to rotate the second member 320 to the plate 201*b* side. However, the second member 320 is hindered by the plate 201*b*, and is not allowed to move in the same direction as the movement of the first member 310.

Additionally, as described with reference to FIG. 7, in the joint member 340, the shaft portion 341*a* that extends from the first joint portion 341 is rotatably inserted into the through hole of the second joint portion 342. The first butting portion 341*b* of the first joint portion 341 is butted against the second butting portion 342*a* of the second joint portion 342 by the urging force of the torsion spring 343 for a joint.

As described above, since the second member 320 is not moved in the same direction as the movement of the first member 310, the second joint portion 342 integral with the second member 320 are not allowed to move in this direction.

On the other hand, the movement of the first member 310 is a movement to rotate the first joint portion 341 integral with the first member 310 with respect to the second joint portion 342, in a direction in which the first butting portion 341*b* separates from the second butting portion 342*a*.

Although the torsion spring 343 for a joint butts the first butting portion 341*b* against the second butting portion 342*a* by an urging force, in the present exemplary embodiment, the urging force is weaker than a force when the detecting claw 312 comes into contact with paper P and the first member 310 rotates to the third posture from the first posture.

Accordingly, when the first member 310 rotates from the first posture to the third posture, the first joint portion 341 idles with respect to the second member 320 and second joint portion 342 that are not allowed to move as described above.

As a result, when the first member 310 rotates from the first posture to the third posture, the posture of the second member 320 in the detecting section 300 is kept in the OFF posture shown in FIGS. 9 and 10.

Figure 14:
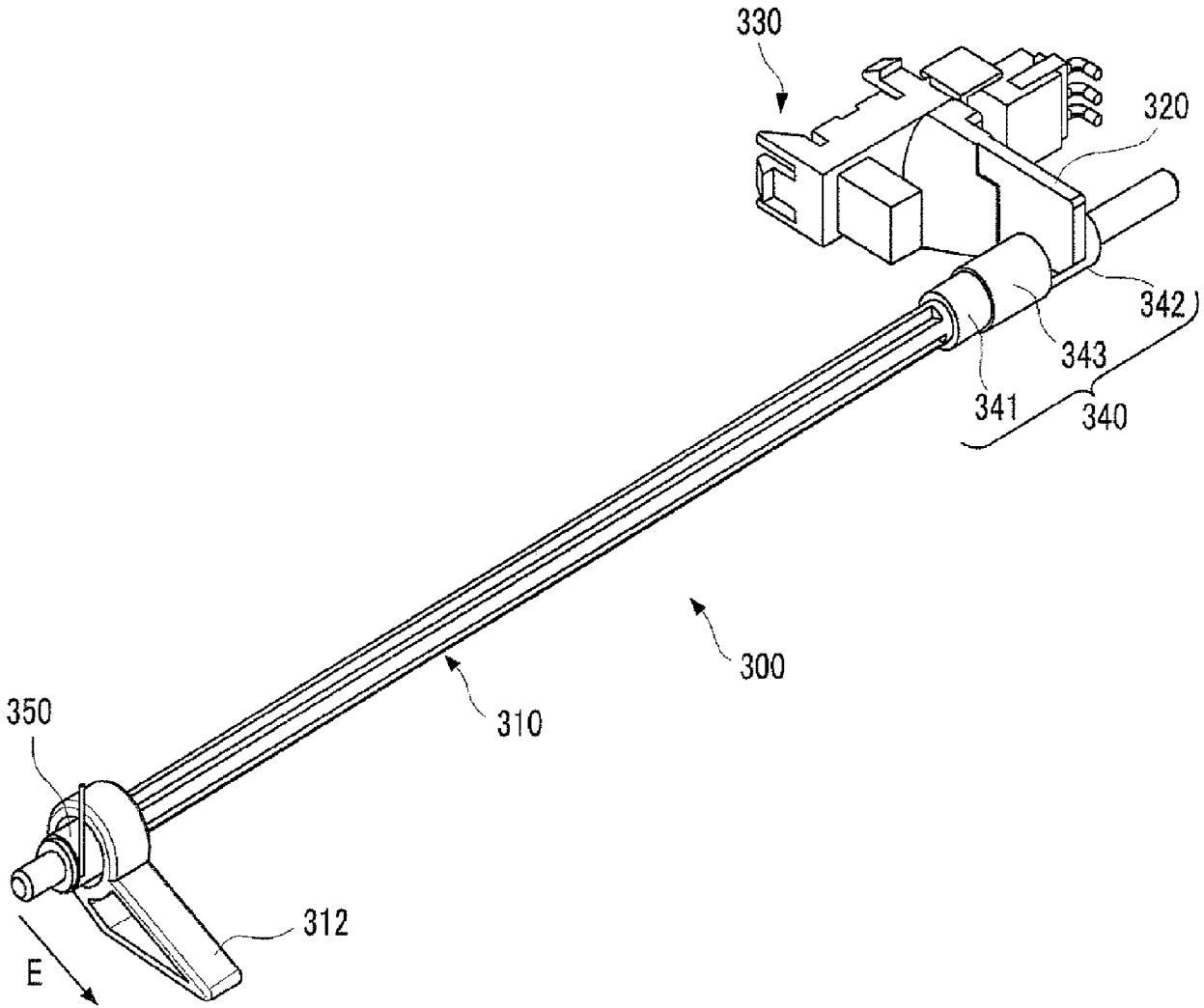
FIG. 14 is a perspective view showing the detecting section when the first member has rotated to a third posture.

FIG. 14 is a perspective view showing the detecting section when the first member has rotated to the third posture.

In the detecting section 300, when the first member 310 rotates in the direction of arrow E from the first posture to the third posture, as described above, in the joint member 340, the first joint portion 341 idles with respect to the second joint portion 342. That is, the joint member 340 does not transmit the movement of the first member 310, which rotates from the first posture to the third posture, to the second member 320, and keeps the second member 320 in the OFF posture.

Here, when the first member 310 comes into contact with the reversed paper P and rotates, if the second member 320 also rotates and takes the ON posture, the detector 330 shown in FIG. 9 or the like is brought into the ON state even at this time. Then, the process for distinguishing two kinds of ON states including the ON state of the detector 330 when paper P moves from the fixing device 100 to the paper ejection roller 203 and the ON state at this time of the reversal of this paper is required.

In the present exemplary embodiment, as described above, since the posture of the second member 320 is kept in the OFF posture at the time of paper reversal, the detector 330 is also kept in the OFF state at the time of paper reversal. Accordingly, the process for distinguishing the above two kinds of ON states is not required, and the processing in the control section 21 of FIG. 1 becomes simple.

Here, when the first member 310 rotates from the first posture to the third posture, the torsion spring 350 for a detecting claw is contracted, and an urging force that returns the first member 310 to the first posture is generated in the torsion spring 350 for a detecting claw.

Additionally the torsion spring 343 for a joint in the joint member 340 urges the first butting portion 341*b* of the first joint portion 341 in a direction in which the first butting portion 341*b* is butted against the second butting portion 342*a* of the second joint portion 342. That is, the torsion spring 343 for a joint urges the first member 310 integral with the first joint portion 341 to the second member 320 side integral with the second joint portion 342. The urging force of the torsion spring 343 for a joint of that directs the first member 310 to the second member 320 side is also equivalent to the urging force that returns the first member 310 to the first posture.

Accordingly, the first member 310 returns to the first posture by a resultant force of the urging force of the torsion spring 350 for a detecting claw, and the urging force of the torsion spring 343 for a joint, at the tinning when the paper P transported in the direction of arrow E as shown in FIG. 13 has passed through the bottom of the detecting claw 312.

The first member 310 that has returned to the first posture tends to rotate to the second posture side beyond the first posture due to inertia. The movement of the first member 310 is a movement to rotate the second member 320 to the ON posture. However, since the center of gravity of the second member 320 is closer to the tip side as described above, the movement of the second member 320, and consequently, the movement of the first member 310 itself caused by inertia are suppressed.

In the detecting section 300, the first member 310 that changes posture thereof among the first posture, the second posture and the third posture is equivalent to an example of the first member in the exemplary embodiments of the invention. Additionally, the rotating shaft 311 in the first member 310 is equivalent to an example of the rotating shaft in the exemplary embodiments of the invention, and the detecting claw 312 in the first member 310 is equivalent to an example of the detecting claw in the exemplary embodiments of the invention.

Additionally, in the detecting section 300, the second member 320 that changes posture thereof between the ON posture and the OFF posture is equivalent to an example of the second member in the exemplary embodiments of the invention. Additionally, the OFF posture of the second member 320 is equivalent to an example of a fourth posture in the exemplary embodiments of the invention, and the ON posture of the second member 320 is equivalent to an example of a fifth posture in the exemplary embodiments of the invention.

Additionally, in the detecting section 300, the joint member 340 that couples the first member 310 and the second member 320 together is equivalent to an example of a joint member in the exemplary embodiments of the invention.

Additionally, in the detecting section 300, the torsion spring 350 for a detecting claw that urges and returns the first member 310 toward the first posture from the second posture is equivalent to an example of an urging member in the exemplary embodiments of the invention.

Next, in a case where paper P is jammed between the fixing device 100 and the ejector 200 in the image forming apparatus 20 shown in FIG. 1, the paper removal processing in which a user removes the jammed paper P will be described.

As described with reference to FIG. 1, in a case where paper P is jammed between the fixing device 100 and the ejector 200, first, the rear panel 29 is opened by the user. The paper removal processing is performed as the user inserts his/her hand into an opening, which has appeared due to the opening of the rear panel 29, from the underside of the document reader 10, and removes the jammed paper P.

Figure 15:
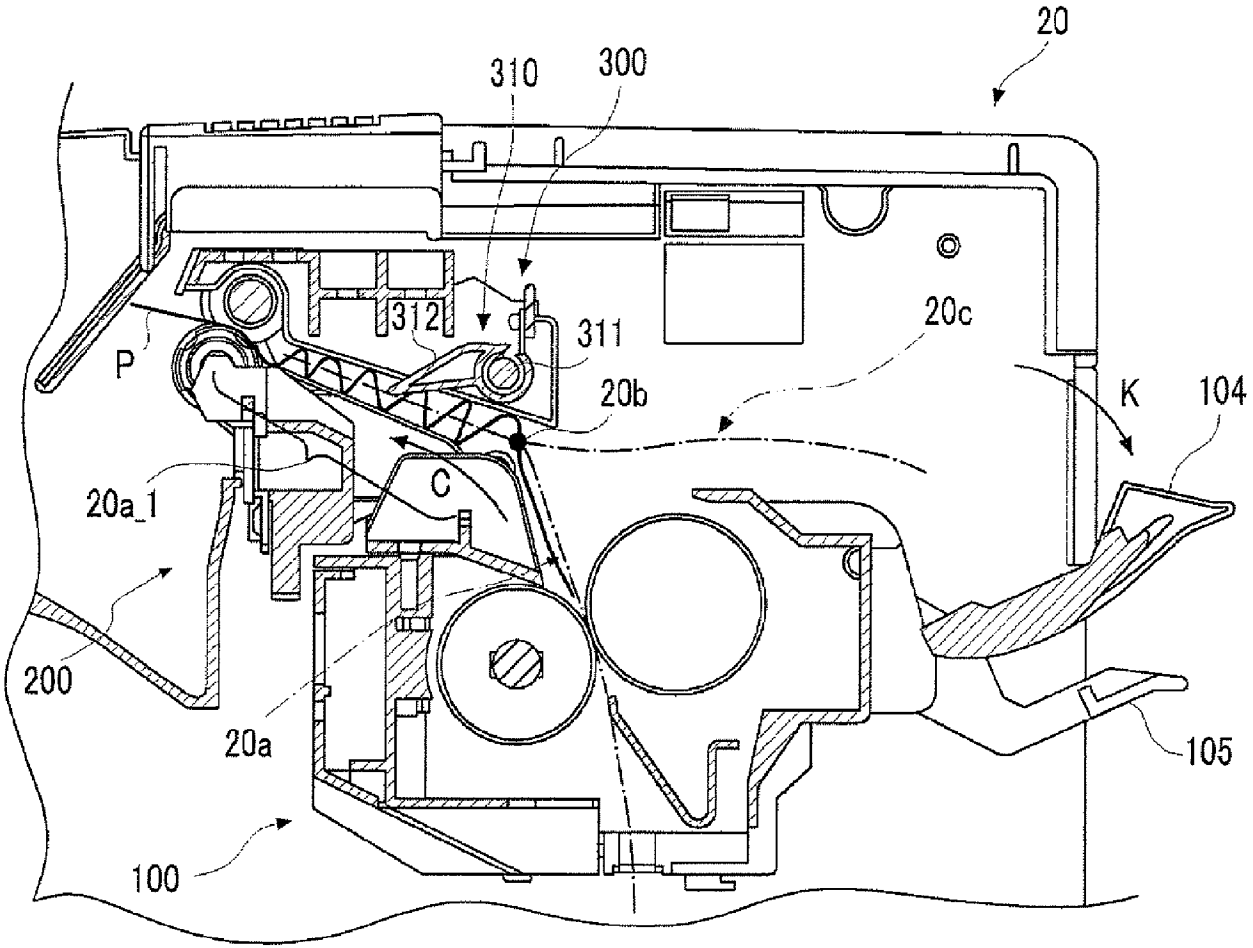
FIG. 15 is a view showing an image forming apparatus during paper removal processing in a case where paper is jammed between the fixing device and the ejector, in the same cross-section as the cross-section of FIG. 2.

FIG. 15 is a view showing the image forming apparatus during paper removal processing in a case where paper is jammed between the fixing device and the ejector, in the same cross-section as the cross-section of FIG. 2.

A typical example of paper jamming between the fixing device 100 and the ejector 200 is schematically shown in FIG. 15. That is, a state where the paper P transported in the direction of arrow C creases within the internal ejector path 20*a*_1, and a portion on the side of the trailing edge of the paper P sticks out to the fixing device 100 side from the internal ejector path 20*a*_1 is shown in FIG. 15. In a case where paper is jammed between the fixing device 100 and the ejector 200, transport of the paper P often stops in the state shown in FIG. 15.

When such paper P is removed, as shown also in FIGS. 3 and 4, the user operates the operating lever 105 of the fixing device 100 to open the cover 104 in the direction of arrow K, to expose the portion between the fixing device 100 and the ejector 200. Then, the user holds a trailing edge portion of the paper P that sticks out to the fixing device 100 side, and pulls out the paper P from the internal ejector path 20*a*_1. The jammed paper P is removed by this operation.

Here, in the present exemplary embodiment, the first member 310 in the detecting section 300 is arranged closer to the reversal position than the branch point 20*b* between the first transport path 20*a* and the second transport path 20*b*.

As described above, the detecting claw 312 of the first member 310 is arranged at the longitudinal center of the ejector 200 shown in FIG. 5. For this reason, if the first member 310 is arranged closer to the fixing device 100 side than the branch point 20*b*, since the detecting claw 312 is located in a working place of a user who removes paper P, the detecting claw becomes an obstacle to paper removal.

In the present exemplary embodiment, since the first member 310 is arranged closer to the reversal position side than the branch point 20*b*, the detecting claw 312 is away from the working place of the user who is going to remove paper P. Accordingly, in the present exemplary embodiment, a situation where the detecting claw 312 becomes an obstacle to paper removal as described above is avoided.

In addition, in the present exemplary embodiment, as described with reference to FIGS. 6 and 7, in the joint member 340, the first joint portion 341 and the second joint portion 342 are coupled together by the urging force of the torsion sprang 343 for a joint. However, the joint member in the exemplary embodiments of the invention is not limited to this form. The joint member in the exemplary embodiments of the invention may be, for example, a form that does not include the torsion spring 343 for a joint. In the joint member of this form, when the first member 310 rotates from the first posture to the second posture, the first joint portion 341 rotates in a state where the first joint portion butts against the second joint portion 342. Thereby, the rotation of the first member 310 to the second posture from the first posture is transmitted to the second member 320. When the first member 310 returns to the first posture, the first joint portion 341 is separated from the second joint portion 342. At this time, the second member 320 rotates to the OFF posture from the ON posture due to its own weight. Additionally, when the first member 310 rotates from the first posture to the third posture, the first joint portion 341 separates from the second joint portion 342. For this reason, the rotation of the first member 310 from the first posture to the third posture is not transmitted to the second member 320, and the posture of the second member 320 is kept in the OFF posture.

Additionally, in the present exemplary embodiment, the return of the first member 310 from the third posture to the first posture is performed by a resultant force of the urging force of the torsion spring 350 for a detecting claw and the urging force of the torsion spring 343 for a joint. However, the first member in the exemplary embodiments of the invention is not limited to this form. Additionally, in the present exemplary embodiment, the return of the first member from the third posture to the first posture is performed by only the urging force of the torsion spring 350 for a detecting claw.

Additionally, in the present exemplary embodiment, both the return of the first member 310 from the second posture to the first posture and the return of the first member from the third posture to the first posture are performed by the urging force of the torsion spring. However, the first member in the exemplary embodiments of the invention is not limited to this form. The first member in the exemplary embodiments of the invention may be a form in which the return of the first member to the first posture is performed, for example, by the weight of the detecting claw.

Additionally, in the present exemplary embodiment, the timing when the first member has returned to the first posture from the second posture is set to the timing when paper P has arrived at the reversal position. However, the invention is not limited thereto. The timing after a predetermined period after the first member returns to the first posture from the second posture may be set to the reversal position.

Additionally, in the present exemplary embodiment, the copying machine 1 has been illustrated as the image forming apparatus in the exemplary embodiments of the invention. However, the image forming apparatus of the invention may not be limited thereto, and may be a printer, facsimile, or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A paper transport device comprising:

a transport section that transports paper to a reversal position in a first direction on a first transport path, and reverses a transport direction to a second direction that is a direction opposite to the first direction at the reversal position, to transport the paper onto a second transport path that branches from the first transport path; and a detecting section that detects that the paper is transported in the first direction, and has arrived at the reversal position, wherein the detecting section includes a first member that is arranged closer to the reversal position side than a branch point on the first transport path branched to the second transport path, and changes posture thereof among a first posture free of the contact with paper, a second posture where the first member comes into contact with the paper transported in the first direction and has rotated in the first direction from the first posture, and a third posture where the first member comes into contact with the paper transported in the second direction and has rotated in the second direction from the first posture, after the paper has passed in the first direction, a second member that changes posture thereof between a fourth posture and a fifth posture by rotation, a detector that (i) detects whether the second member is in the fourth posture or in the fifth posture, and (ii) keeps detecting the second member even if the first member rotates toward the third posture from the first posture, and a joint member that couples the first member and the second member together, allows the second member to be in the fourth posture when the first member is in the first posture, rotates the second member to the fifth posture when a movement in which the first member rotates toward the second posture from the first posture is transmitted to the second member and the first member has rotated to the second posture, and does not transmit a movement in which the first member rotates toward the third posture from the first posture, to the second member, and keeps the second member in the fourth posture.

2. The paper transport device according to claim 1, wherein the first member has a detecting claw that changes to the first to third postures, and a rotating shaft that supports the detecting claw at one end thereof and extends in a paper width direction, the joint member is arranged between an other end of the rotating shaft and the second member, and an urging member is further provided at the one end of the rotating shaft to urge the detecting claw from the second posture toward the first posture.

3. The paper transport device according to claim 2, further comprising:

a rotation inhibiting portion that comes into contact with the second member in the fourth posture to inhibit a rotation in a direction opposite to a rotation that is directed toward the fifth posture from the fourth posture.

4. The paper transport device according to claim 3, wherein the second member has a center of gravity at a position farther from a rotating shaft of the second member than a middle point of a line segment that connects the rotating shaft of the second member and a tip farthest from the rotating shaft of the second member in a radial direction.

5. The paper transport device according to claim 1, further comprising:

a rotation inhibiting portion that comes into contact with the second member in the fourth posture to inhibit a rotation in a direction opposite to a rotation that is directed toward the fifth posture from the fourth posture.

6. The paper transport device according to claim 5, wherein the second member has a center of gravity at a position farther from a rotating shaft of the second member than a middle point of a line segment that connects the rotating shaft of the second member and a tip farthest from the rotating shaft of the second member in a radial direction.

7. The paper transport device of claim 1, wherein the first member has a detecting claw that changes to the first to third postures, and a rotating shaft that supports the detecting claw at one end thereof and extends in a paper width direction, and wherein the joint member is arranged between an other end of the rotating shaft and the second member.

8. An image forming apparatus comprising:

an image forming section that forms an image on one side of transported paper;

a transport section that transports paper to a reversal position on the downstream side of the image forming section, in a first direction passing through the image forming section on a first transport path that goes via the image forming section, reverses a transport direction to a second direction from the first direction at the reversal position, to transport the paper on a second transport path branching from the first transport path and bypassing the image forming section, and reverses the front and back of the paper to join the paper to the first transport path again on the upstream side of the image forming section to direct the paper to the image forming section; and a detecting section that detects that the paper is transported in the first direction, and has arrived at the reversal position, the detecting section including:

a first member that is arranged closer to the reversal position side than a branch point on the first transport path branched to the second transport path, and changes posture thereof among a first posture free of the contact with paper, a second posture where the first member comes into contact with the paper transported in the first direction and has rotated in the first direction from the first posture, and a third posture where the first member comes into contact with the paper transported in the second direction and has rotated in the second direction from the first posture, after the paper has passed in the first direction;

a second member that changes posture thereof between a fourth posture and a fifth posture by rotation;

a detector that (i) detects whether the second member is in the fourth posture or in the fifth posture, and (ii) keeps detecting the second member even if the first member rotates toward the third posture from the first posture; and a joint member that couples the first member and the second member together, allows the second member to be in the fourth posture when the first member is in the first posture, rotates the second member to the fifth posture when a movement in which the first member rotates toward the second posture from the first posture is transmitted to the second member and the first member has rotated to the second posture, and does not transmit a movement in which the first member rotates toward the third posture from the first posture, to the second member, and keeps the second member in the fourth posture.

9. The image forming apparatus according to claim 8, wherein the first member has a detecting claw that changes to the first to third postures, and a rotating shaft that supports the detecting claw at one end thereof and extends in a paper width direction, the joint member is arranged between an other end of the rotating shaft and the second member, and an urging member is further provided at the one end of the rotating shaft to urge the detecting claw from the second posture toward the first posture.

10. The image forming apparatus according to claim 9, further comprising:

a rotation inhibiting portion that comes into contact with the second member in the fourth posture to inhibit a rotation in a direction opposite to a rotation that is directed toward the fifth posture from the fourth posture.

11. The image forming apparatus according to claim 10, wherein the second member has a center of gravity at a position farther from a rotating shaft of the second member than a middle point of a line segment that connects the rotating shaft of the second member and a tip farthest from the rotating shaft of the second member in a radial direction.

12. The image forming apparatus according to claim 8, further comprising:

a rotation inhibiting portion that comes into contact with the second member in the fourth posture to inhibit a rotation in a direction opposite to a rotation that is directed toward the fifth posture from the fourth posture.

13. The image forming apparatus according to claim 12, wherein the second member has a center of gravity at a position farther from a rotating shaft of the second member than a middle point of a line segment that connects the rotating shaft of the second member and a tip farthest from the rotating shaft of the second member in a radial direction.

14. The image forming apparatus according to claim 8, wherein the first member has a detecting claw that changes to the first to third postures, and a rotating shaft that supports the detecting claw at one end thereof and extends in a paper width direction, and wherein the joint member is arranged between an other end of the rotating shaft and the second member.

* * * * *